US006544347B2

(12) United States Patent
Lucey, Jr. et al.

(10) Patent No.: US 6,544,347 B2
(45) Date of Patent: Apr. 8, 2003

(54) METHODS FOR USING A RING-VORTEX

(75) Inventors: George K. Lucey, Jr., Burtonsville, MD (US); Thomas Gher, Laurel, MD (US); Guy Cooper, Ventura, CA (US); Robert J. Richter, Gloucester, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/802,605

(22) Filed: Mar. 12, 2001

(65) Prior Publication Data

US 2003/0029476 A1 Feb. 13, 2003

(51) Int. Cl.[7] ..... B08B 3/02

(52) U.S. Cl. ..... 134/34; 134/19; 134/22.11; 134/22.12; 134/42

(58) Field of Search ..... 134/7, 19, 22.11, 134/22.12, 34, 42

(56) References Cited

U.S. PATENT DOCUMENTS 5,823,434 A * 10/1998 Cooper ..... 239/102.2
6,203,406 B1 * 3/2001 Rose et al. ..... 451/39
6,345,630 B2 * 2/2002 Fishkin et al. ..... 134/1.3

FOREIGN PATENT DOCUMENTS

JP 11-184420 * 7/1999

OTHER PUBLICATIONS

Vortex Ring Generator: Mechanical Engineering Design for 100–kpsi Operating Pressures, George K. Lucey, Jr. ARL–TR 2096, Jan. 2000.

Control of Vortex Breakdown in a Rotating Flow: Numerical Simulation. Nadine Aubry, B.H. Jorgensen, J.N. Sorensen, DFD98 Meeting of The American Physical Society Nov. 23, 1998.

Interaction between a Vortex Dipole and a Circular Cylinder, R. Verzicco, J.B. Flor, G.J.F. vanHeijst and P). Orlandi Exp. Fluids 18, 153–163 (1995).

A Small History of Stentecs Wind Energy Projects No Date.

* cited by examiner

*Primary Examiner*—Zeinab El-Arini
(74) *Attorney, Agent, or Firm*—William W. Randolph; Paul S. Clohan, Jr.

(57) ABSTRACT

A vortex ring is used to produce a flow of fluid through a flexible tube, to remove surface deposits from a surface, and to transfer heat from a platen to a ring vortex. In pumping a fluid through a flexible conduit or tube, a vortex ring is launched along the tube so that the vortex ring encircles the tube. The vortex ring compresses and expands the flexible tube utilizing a high circumferential pressure formed at the bow of the vortex ring and a low pressure at the wake of the vortex ring. In removing deposits from a surface, a vortex ring launched along the surface mechanically abrades the surface and fractures the adhesion bonds of the surface deposits. In transferring heat from a heated surface to a vortex ring, the vortex ring removes the heat from the surface of the heated platen by forced convection.

3 Claims, 9 Drawing Sheets

METHODS FOR USING A RING-VORTEX

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

This invention relates to methods for extracting useful work from vortex rings and more specifically useful work such as pumps, filters and heat exchangers.

2. Discussion of Related Art

The vast majority of literature, patents, and dual-use products relate to monopole vortices, i.e., A spinning column of gas (tornado) or liquid (whirlpool) traversing normal to the vertical axis (see FIG. 1). Studies relate to weather prediction, flight safety through aircraft wingtip vortices, mixing in engines and appliances, etc. More recently, attention has been devoted to the ring-vortex, which is a gas or liquid torus spinning about the torus core and moving in a direction normal to the torus circumference (see FIG. 2). Typical interests are in transporting chemicals, momentum transfer to a target, contributions to turbulent flow, propeller noise and drag, fluid crash back against ship propellers, micro-bursts on the ground arising from propeller down wash or wind gusts, underwater sewage pipe backwash into the diffuser, etc.

No successful implementation of ring-vortex technology is found in military products. Commercial applications are only found for toy guns and theater cannons. One reason is a lack of engineering equations needed to design hardware for launching vortices with specified axial and spin velocities, forecasting the vortex resistance to dispersion in cross winds, forecasting resistance to shattering in wind gusts, estimating the in-flight leakage of chemicals being transported to a target, and estimating the loss of axial and angular momentum in flight. These gaps in technology arise from an incomplete understanding of the mechanisms of ring-vortex formation. As a result, the parameters critical to control to assure optimum vortex performance in flight and during target impact are unknown. Ring-vortex research has consequently centered on empirical trial and error, and no successful fielding of a device using a ring-vortex to perform useful work was found.

U.S. Pat. No. 5,823,434 shows a ring-vortex generator designed to launch an array of ring vortices spaced to avoid destructive interaction. Identical capabilities are defined in our invention but the primary difference is a fluidic flip-flop pressure pulse generator is used to launch vortices rather than a vibrating membrane. The advantage is operational flexibility; i.e., adjusting the flip-flop frequency alters the axial spacing between ring vortices, and regulating manifold pressure controls the angular and axial momentum of each ring-vortex.

A report entitled "Control of vortex breakdown in a rotating flow: Numerical Simulation" authored by Nadine Aubry et. al. (DFD98 Meeting of The American Physical Society, Nov. 23, 1998) describes a rod placed along the axis of a vortex. Our invention places a rod along a ring-vortex axis of propagation, but the mechanics and objectives are different. In the cited report, the vortex is a mono-pole (whirlpool), the rod is spinning, the rod is placed along the low-pressure whirlpool axis, and the objective is to prevent the formation of ring vortices that tend to destroy the whirlpool. Our invention addresses a dipole (torus) vortex, the rod is placed normal to, and mid-way between the two axis of revolution, and the objective is to create a surface area in the region of highest velocity for the purpose of extracting useful work from the vortex.

A report entitled "Numerical and experimental study of the interaction between a vortex dipole and a circular cylinder" authored by R. K. Verzicco et. al. (Exp. Fluids 18, 153–163) discusses a ring-vortex interaction with a circular rod, as does our invention. In this report, the ring-vortex motion is perpendicular to the rod, and the goal was to examine the change in the free surface since this is relevant to sound generation. In our invention, the ring-vortex is concentric with the rod, moves along the axis of the rod, and performs work on the rod.

SUMMARY OF THE INVENTION

Accordingly, it is an object of the present invention to describe methods for extracting useful work from a ring-vortex It is another object of the invention to describe useful ring-vortex work items such as pumps, filters and heat exchangers.

The foregoing and other objects are achieved by the several methods presented for extracting useful work from a ring-vortex moving at high angular and axial velocities. The key components are a ring-vortex generator or launcher, a platen that penetrates the ring-vortex centroid along the axis of revolution, and a collector. Typical applications that utilize different parameters of a ring-vortex include a pump, filter, and heat exchanger.

The launcher will launch a gas or liquid ring-vortex around the circumference of a platen and toward a collector. For compressible flow the nozzle of the launcher may be designed to form vortices from subsonic or supersonic jet streams. In the latter instance, designing the nozzle to achieve atmospheric pressure at the exit maximizes the velocity and spin at which the ring-vortex is launched from the jet stream. To improve efficiency, a chain of vortices may be launched and harvested.

The collector will retrieve materials entrained by the ring-vortex for the purpose of disposal or salvage. The location may be downstream or at the end of the platen, at the launch site when a reflector is placed opposite the launcher, or absent if other means of collection are used One purpose of the platen is to guide the ring-vortex from the launcher to the collector. The reason is that cross-flow against a platen with a traversing vortex generates magnus forces that promote dispersion. The platen establishes a resisting torque that maintains the course of ring-vortex propagation. Another purpose of the platen is to provide a large surface area in the region of highest ring-vortex velocity. The platen surface may be irregular as shown in FIG. 4 if the shape does not destroy the vortex integrity. An illustrative example in FIG. 4 is longitudinal fins The vortex-ring will perform work on the platen surface using the inherent properties of the torus core and the trailing wake. The work performed by the ring-vortex depends upon the configuration of the platen.

When used as a pump, the platen is a flexible tube containing a fluid or gas, and the critical ring-vortex parameter of interest is the pressure distribution on the platen. The launcher forms a ring-vortex around the tube circumference, and a high circumferential pressure forms at the bow and a low pressure forms at the wake of the vortex-ring. The flexible platen compresses and expands accordingly, and as the ring-vortex moves, the pinching action also moves and pumps the material inside the tube.

As a filter, the platen is configured electrically, mechanically, thermally, magnetically, chemically, or otherwise to form surface deposits or to extract materials from the surrounding environment. The ring-vortex mechanically abrades the platen surface, fractures the adhesion bonds of surface residues, lifts the residues from the surface, entrains the residues in the torus core, and transports the residues to the collector for recovery or disposal. Typical surface residues are gas bubbles, condensates, dirt, salts, rust, metal chips, etc. The critical parameters are the angular momentum about the torus core, the height of the torus core center above the platen, and the axial momentum.

When used as a heat exchanger, the platen is a heated bar and the ring-vortex transfers heat by means of forced convection. The critical parameters are spin and axial velocities and the direction of flow. Traditional heat exchangers of this type utilize coolant flows that are normal to or in-line with the platen, and their performances are degraded by boundary layers and flow separations that reduce the coolant velocity and the area of contact. The ring-vortex is not subject to these limitations for the reasons described below.

The ring-vortex is unique in that it subjects the platen to both types of flow simultaneously; i.e., the spinning torus directs flow into and away from the surface in a nearly perpendicular fashion and flow in the wake is largely parallel to the platen. Additionally, the ring-vortex is unique in that the velocity within the torus is the vector sum of the angular and axial velocities and high Reynolds numbers are achieved without boundary layers that degrade the film coefficient of heat transfer and without the loss of laminar flow needed to entrain particulates in the torus core. Finally the ring-vortex encircles the platen and traverses the length, thereby assuring contact with the entire surface area.

The ring-vortex may be used to transfer heat in a standalone fashion or in conjunction with the traditional cross-flow and in-line designs. In the latter mode the ring-vortex will reduce maintenance and operating costs by removing surface contaminants that degrade the surface conductance, film coefficient, and emissivity of the platen and thereby degrade efficiency.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
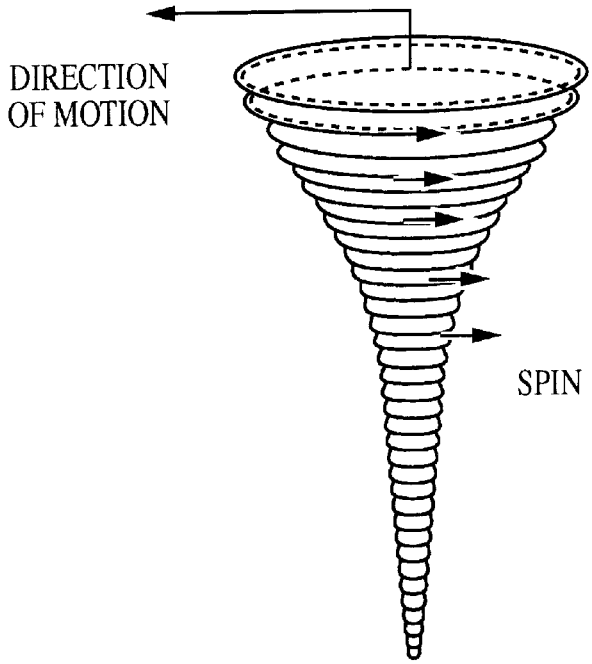
FIG. 1 shows a spinning column of gas or liquid traversing normal to the vertical axis.
Figure 2:
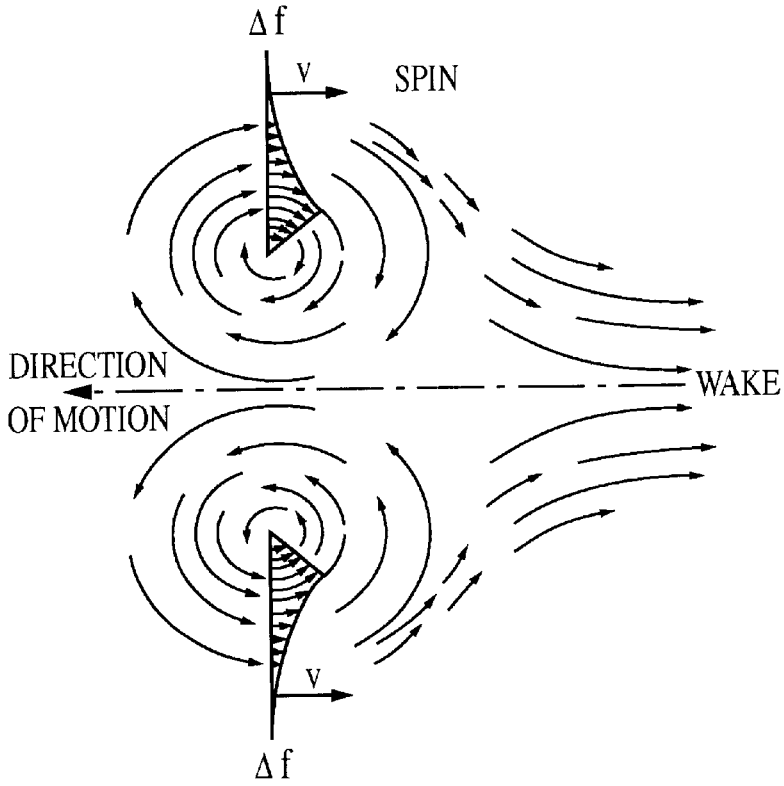
FIG. 2 shows a gas or liquid torus spinning about the torus core and moving in a direction normal to the torus circumference, also known as a ring-vortex.
Figure 3:
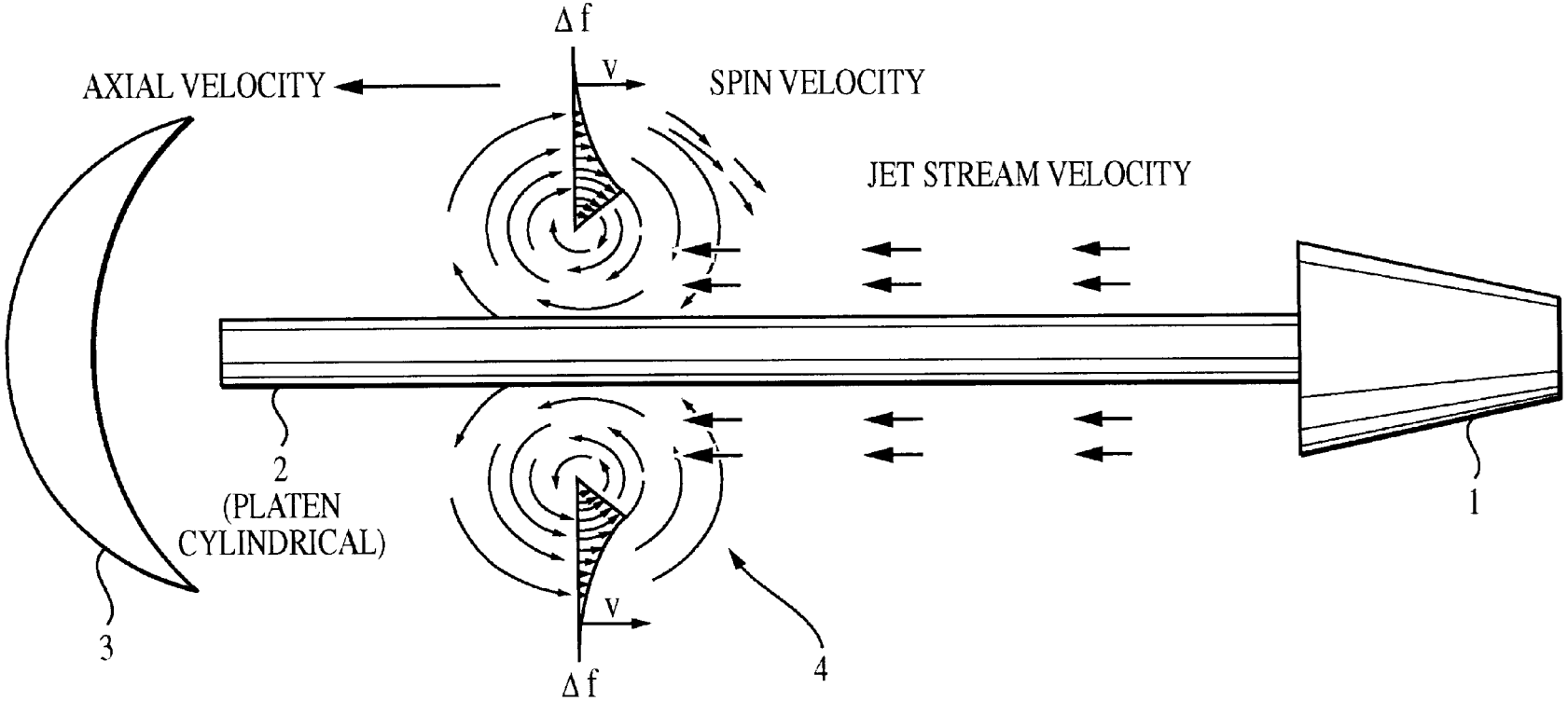
FIG. 3 shows the essential elements of the present invention.
Figure 4:
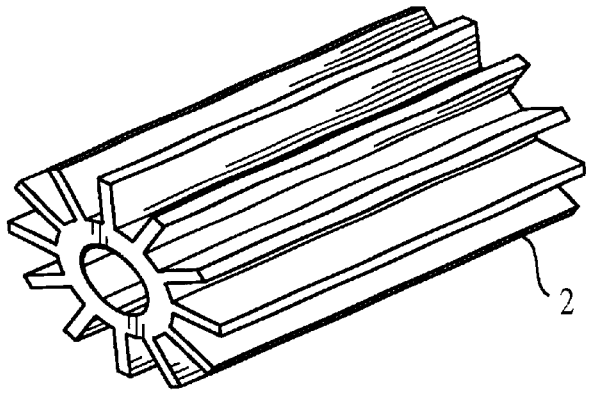
FIG. 4 shows an irregular platen with longitudinal fins.

Our invention is several methods for extracting useful work from a ring-vortex 4 moving at high angular and axial velocities. The key components are a ring-vortex generator (launcher) 1, a platen 2 that penetrates the ring-vortex 4 centroid along the axis of revolution, and a collector 3 as shown in FIG. 3.

a. Launcher 1:

The purpose of launcher 1 is to launch a gas or liquid ring-vortex 4 of predetermined size, spin, velocity around the circumference of platen 2 and toward collector 3. For compressible flow the nozzle of launcher 1 may be designed to form vortices from subsonic or supersonic jet streams. In the latter instance, designing the nozzle to achieve atmospheric pressure at the exit maximizes the velocity and spin at which ring-vortex 4 is launched from the jet stream. To improve efficiency, a chain of vortices 4 may be launched and harvested.

b. Collector 3:

The purpose of collector 3 is to retrieve materials entrained by ring-vortex 4 for the purpose of disposal or salvage. The location may be downstream or at the end of platen 2, at the launch site when a reflector is placed opposite launcher 1, or absent if other means of collection are used c. Platen 2:

1. One purpose of platen 2 is to guide ring-vortex 4 from launcher 1 to collector 3. The reason is that cross-flow against a platen with a traversing ring-vortex generates magnus forces that promote dispersion. The platen establishes a resisting torque that maintains the course of ring-vortex propagation.
2. Another purpose of platen 2 is to provide a large surface area in the region of highest ring-vortex velocity. The platen surface may be irregular as shown in FIG. 4 if the shape does not destroy the vortex integrity. An illustrative example in FIG. 4 is longitudinal fins d. Ring Vortex 4:

The purpose of vortex-ring 4 is to perform work on platen 2 surface using the inherent properties of the torus core and the trailing wake. The work performed by ring-vortex 4 depends upon the configuration of platen 2. Typical applications that utilize different parameters of a ring-vortex include a pump, filter, and heat exchanger. Critical parameters of ring-vortex 4 in these instances are the axial pressure distribution, the angular velocity about the torus core, the axial velocity, and the height of the torus core above platen 2.

Figure 5:
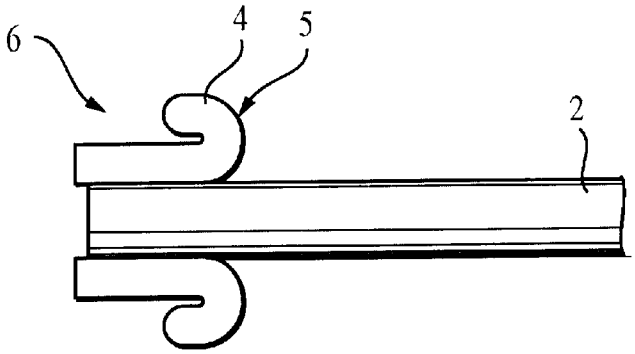
FIG. 5 shows a computer simulation of a pump embodiment of the present invention.
Figure 6:
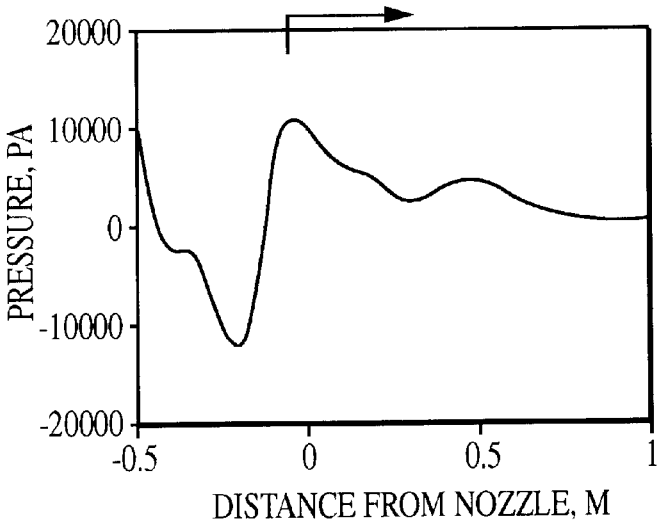
FIG. 6 is a graph of the simulation of FIG. 5.

1. Pump Embodiment: In this application platen 2 is a flexible tube containing a fluid or gas, and the critical ring-vortex parameter of interest is the pressure distribution on platen 2. As described previously, launcher 1 forms a ring-vortex 4 around the tube circumference, and computer simulation shown in FIGS. 5 & 6 shows a high circumferential pressure at bow 5 and a low pressure at wake 6 of vortex-ring 4. The flexible platen 2 compresses and expands accordingly, and as ring-vortex 4 moves, the pinching action also moves and pumps the material inside the tube.

2. Filter embodiment: In this application platen 2 is configured electrically, mechanically, thermally, magnetically, chemically, or otherwise to form surface deposits or to extract materials from the surrounding environment. Ring-vortex 4 mechanically abrades platen 2 surface, fractures the adhesion bonds of surface residues, lifts the residues from the surface, entrains the residues in the torus core, and transports the residues to collector 3 for recovery or disposal. Typical surface residues are gas bubbles, condensates, dirt, salts, rust, metal chips, fibers, etc. The critical parameters are the angular momentum about the torus core, the height of the torus core center above platen 2, and the axial momentum.

The surface residues provide a cross sectional area upon which oblique drag forces are applied by ring-vortex 4. The impulse felt by the residues must be sufficient to fracture surface adhesions or induce mechanical erosion. Since the impulse is related to the combined angular and axial momentums of ring-vortex 4, vortex ring launcher 1 must be adjustable in operating pressure and nozzle dimensions to launch vortices with sufficient mass, spin, and velocity.

Once the surface adhesion is fractured, the drag forces lift the lighter particulates with the larger surface areas in a nearly vertical fashion and entrain them in the torus core from the outside diameter inward. The axial momentum then transports the residuals to collector 3 for recovery or disposal.

Physical sorting of the residues by weight and shape may also be performed; i.e., to filter increasingly heavier residuals launcher 1 must be reconfigured to generate vortices 4 with increasingly higher spin. To carry larger quantities of residuals, the diameter of the torus core must be increased, or chains of vortices must be launched.

Figure 7:
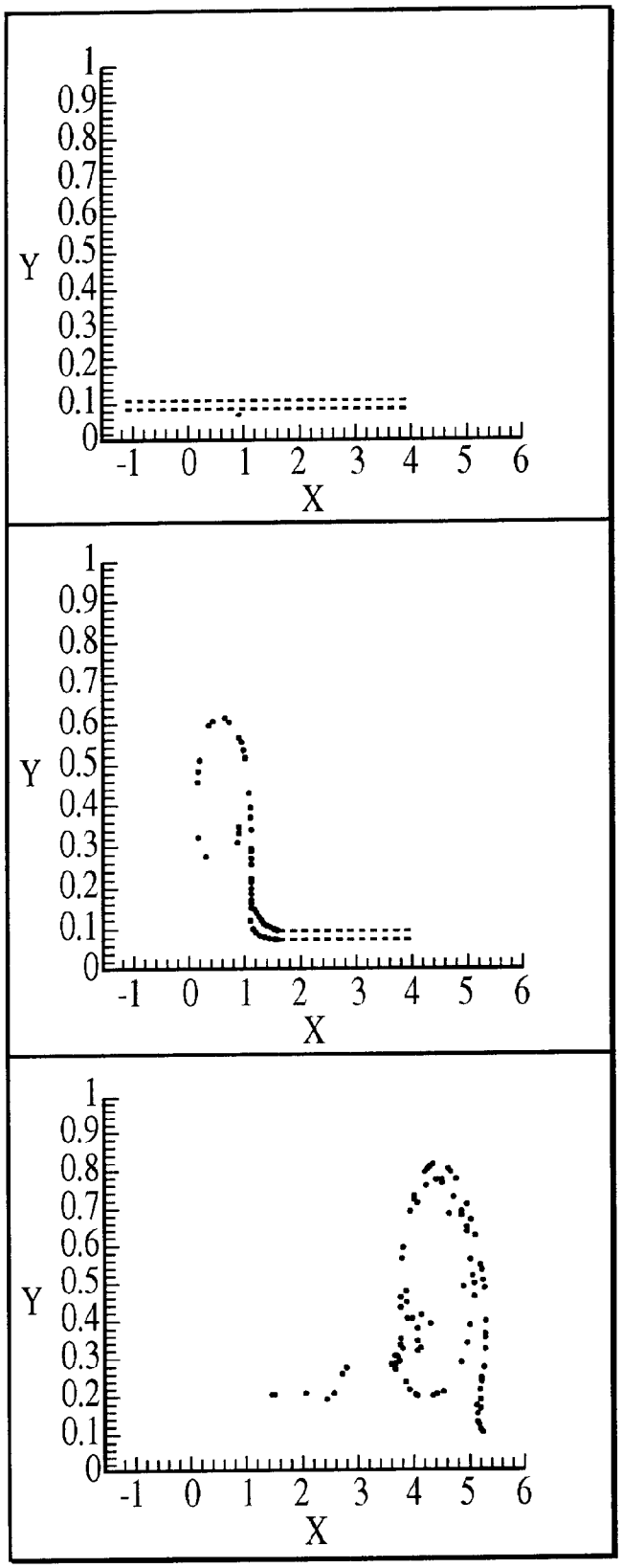
FIG. 7 shows a computer simulation of water droplets being lifted from the surface of a platen.

A computer simulation of water droplets being lifted from the surface of platen 2 is shown in FIG. 7. The top graph in this figure shows water droplets on a plated prior to the launch of ring-vortex 4. In the middle graph, the ring-vortex launch is left to right. Droplets are lifted vertically and entrained into the torus core from the outside diameter inward. In the bottom graph, the entrained droplets are transported axially towards collector 3, but some spillage occurs well above platen 2. The interaction of the spinning torus core with the axial jet stream trailing the core results in spillage. To minimize the possibility of resettling onto platen 2, the core diameter of the torus should be large and chains of vortices should be used for spillage clean up.

3. Heat exchanger embodiment: In this application platen 2 is a heated bar and ring-vortex 4 transfers heat by means of forced convection. The critical parameters are spin and axial velocities and the direction of flow. Traditional heat exchangers of this type utilize coolant flows that are normal to or in-line with platen 2, and their performances are degraded by boundary layers and flow separations that reduce the coolant velocity and the area of contact. Ring-vortex 4 is not subject to these limitations for the reasons described below.

Ring-vortex 4 is unique in that it subjects platen 2 to both types of flow simultaneously; i.e., The spinning torus directs flow into and away from the surface in a nearly perpendicular fashion and flow in the wake is largely parallel to platen 2. Additionally, ring-vortex 4 is unique in that the velocity within the torus is the vector sum of the angular and axial velocities and high Reynolds numbers are achieved without boundary layers that degrade the film coefficient of heat transfer and without the loss of laminar flow needed to entrain particulates in the torus core. Finally ring-vortex 4 encircles platen 2 and traverses the length, thereby assuring contact with the entire surface area.

Ring-vortex 4 may be used to transfer heat in a stand-alone fashion or in conjunction with the traditional cross-flow and in-line designs. In the latter two modes ring-vortex 4 will reduce maintenance and operating costs by removing surface contaminants that degrade the surface conductance, film coefficient, and emissivity of platen 2 and thereby degrade efficiency.

Figure 8:
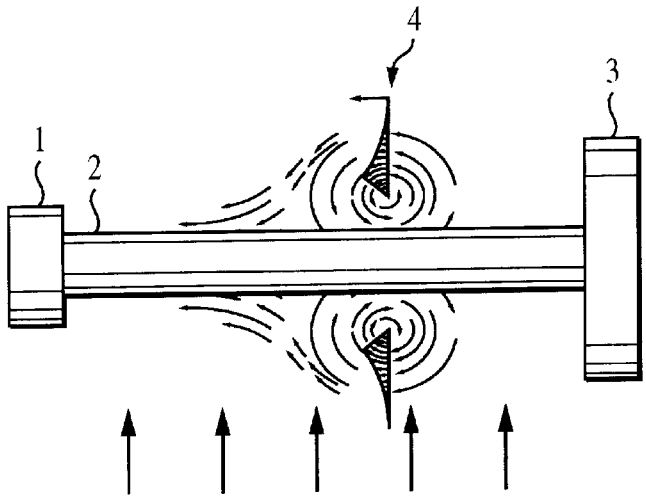
FIG. 8 shows a cross flow heat exchanger supplemented by a ring-vortex.

An illustrative example of a cross flow heat exchanger supplemented by a ring-vortex is shown in FIG. 8. In this system launcher 1 must be adjusted to provide ring-vortex 4 with the angular and axial velocities needed to resist dispersion or shattering.

Figure 9:
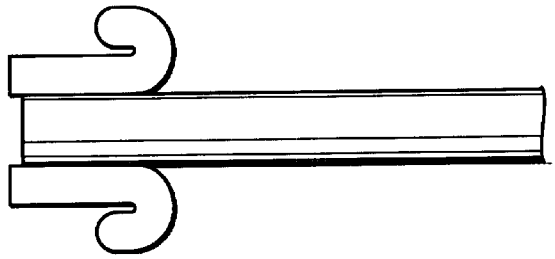
FIG. 9 shows a computer simulation of a heat exchanger embodiment of the present invention.
Figure 10:
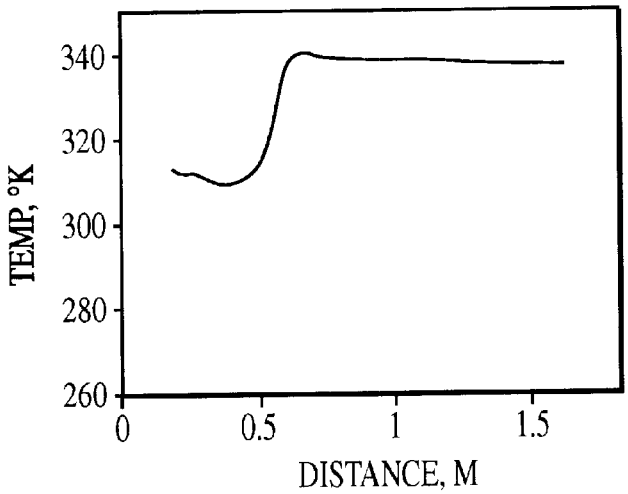
FIG. 10 is a graph of the simulation of FIG. 9.

The computer simulation shown in FIGS. 9 and 10 is a ring-vortex 4 forming 50 ms after a launch at 1 atmosphere pressure from a nozzle 0.3 m in diameter. The temperature distribution is calculated at a depth of 0.001 m in a copper platen 0.15 m diameter×1.65 m length. The bar was preheated to 370 K and experiencing free convection prior to the launch. Maximum cooling is directly beneath the spin center of the torus core.

Preferred Embodiment

Figure 11:
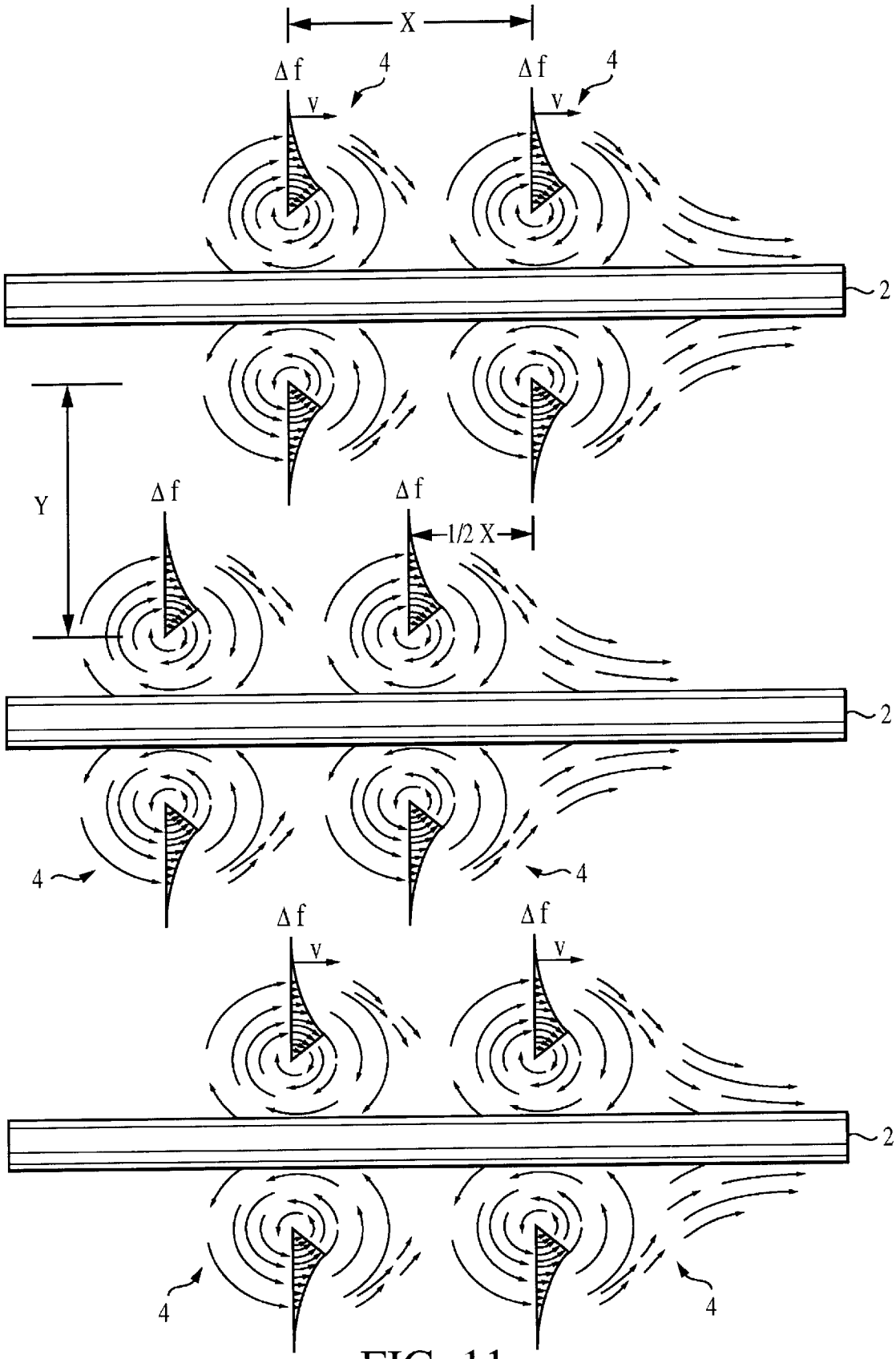
FIG. 11 shows the preferred embodiment of the present invention.

To increase the work output, chains of ring vortices 4 are launched and harvested along banks of platens 2 as shown in FIG. 11. The axial spacing (X,Y) between vortices 4 must be controlled to avoid interfering flow patterns that disintegrate ring-vortex 4.

Figure 12:
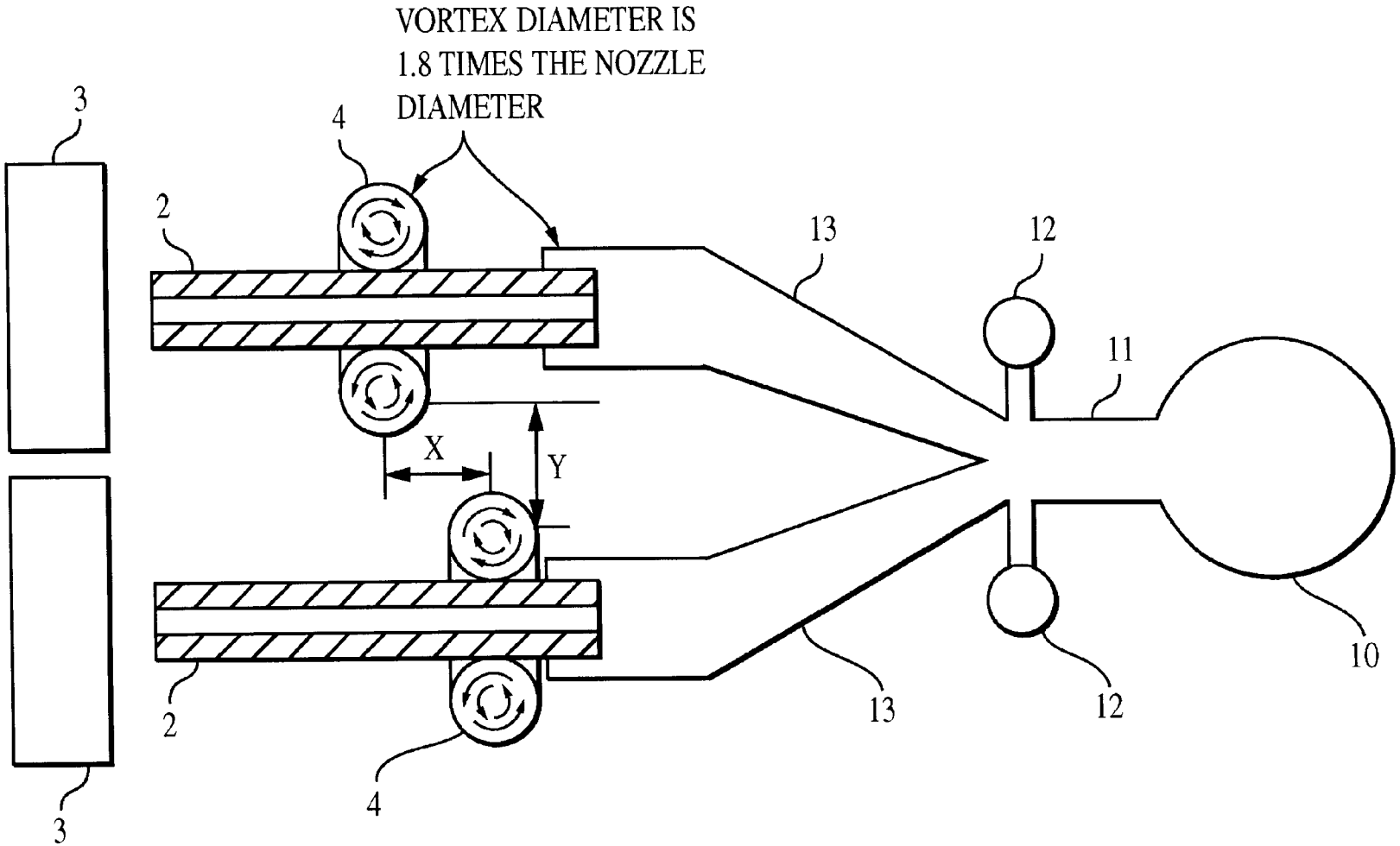
FIG. 12 shows a fluidic flip-flop pressure-pulse generator.

A fluidic flip-flop pressure-pulse generator is a low cost means of generating chains of ring vortices 4 and is shown in FIG. 12. This device is preferred because it has the capability of adjusting the ring-vortex axial spacing, diameter, and total velocity to meet specified work performance criteria on platen 2. This flip-flop was originally invented as an amplifier for use in gas or liquid circuits intended to be alternatives to electrical controllers.

The fluidic flip-flop generator consists of a manifold 10 containing high pressure fluids or gasses, an orifice channel 11 that establish the main jet stream, two lower pressure reservoirs 12 that apply momentary lateral impulses that deflect the jet stream into the up or down nozzles, and two nozzles 13 that expand the jet stream to a user defined velocity.

As the jet stream exits nozzle 13, drag forces at the tip initiate a radial expansion that ultimately rolls into a ring-vortex 4. Applying a lateral impulse 12 flips the jet stream to the opposite nozzle and generates another ring-vortex. Adjusting the dwell time between nozzles 13 controls the axial ring-vortex spacing X. Adjusting the nozzle diameter controls the ring-vortex diameter and thereby the vertical spacing Y. Adjusting the manifold pressure, ring-vortex material, and duration of flow in the expansion nozzle 13 controls the axial and angular velocities of ring-vortex 4.

General design guidelines are to separate vortices an axial and vertical distance equal to the torus diameter, which is roughly 1.8 times the exit diameter of nozzle 13. Closer spacing requires testing to avoid destructive interference between vortices. The maximum axial velocity of a ring-vortex is the ambient speed of sound, and the maximum spin is achieved in compressible gasses fully expanded to supersonic jet stream velocities without a normal shock (mach disk) at the nozzle exit.

Figure 13:
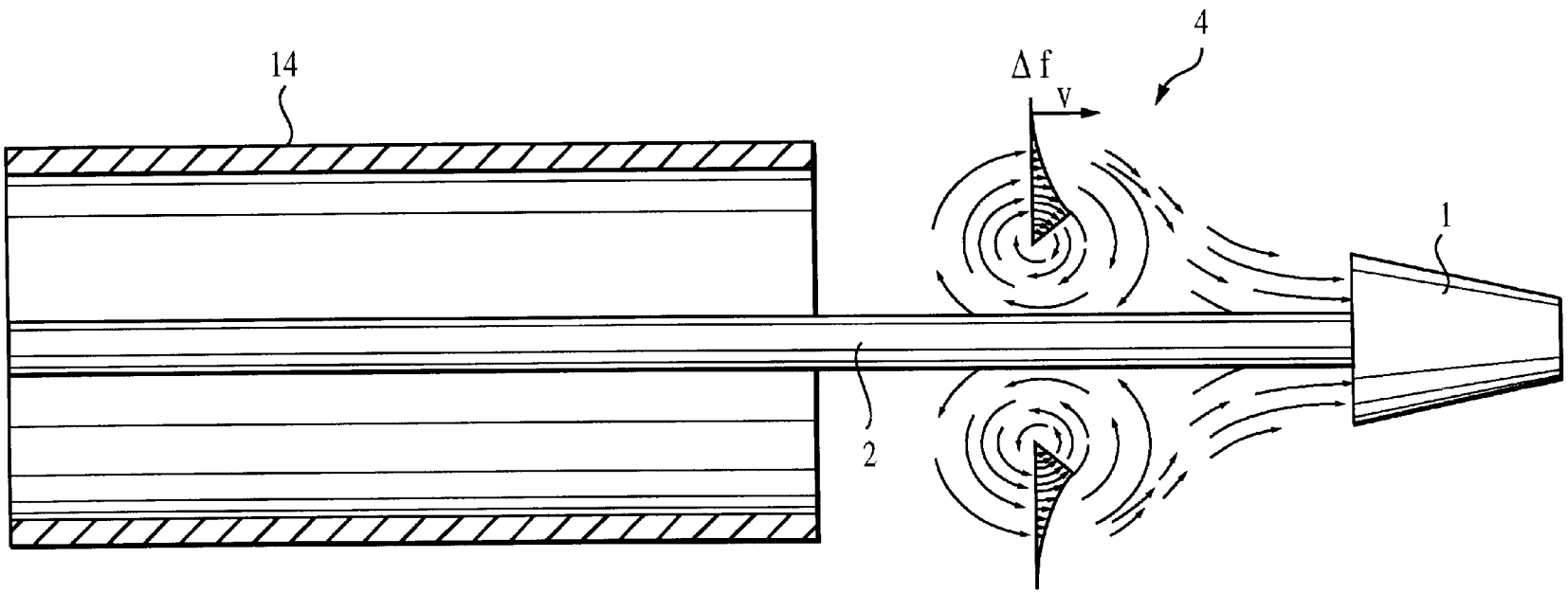
FIG. 13 shows a shroud around a platen.

As shown in FIG. 13, in some applications a shroud 14 is needed around platen 2 for safety reasons. In the past, use of a ring vortex within a tube has been avoided due to a tendency to self-destruct by diving into the wall if alignment is not perfect. The use of a platen tends to resist this motion by developing a counteracting torque. The shroud must be designed with dimensions and a location that enable the ring-vortex to fully form.

Figure 14:
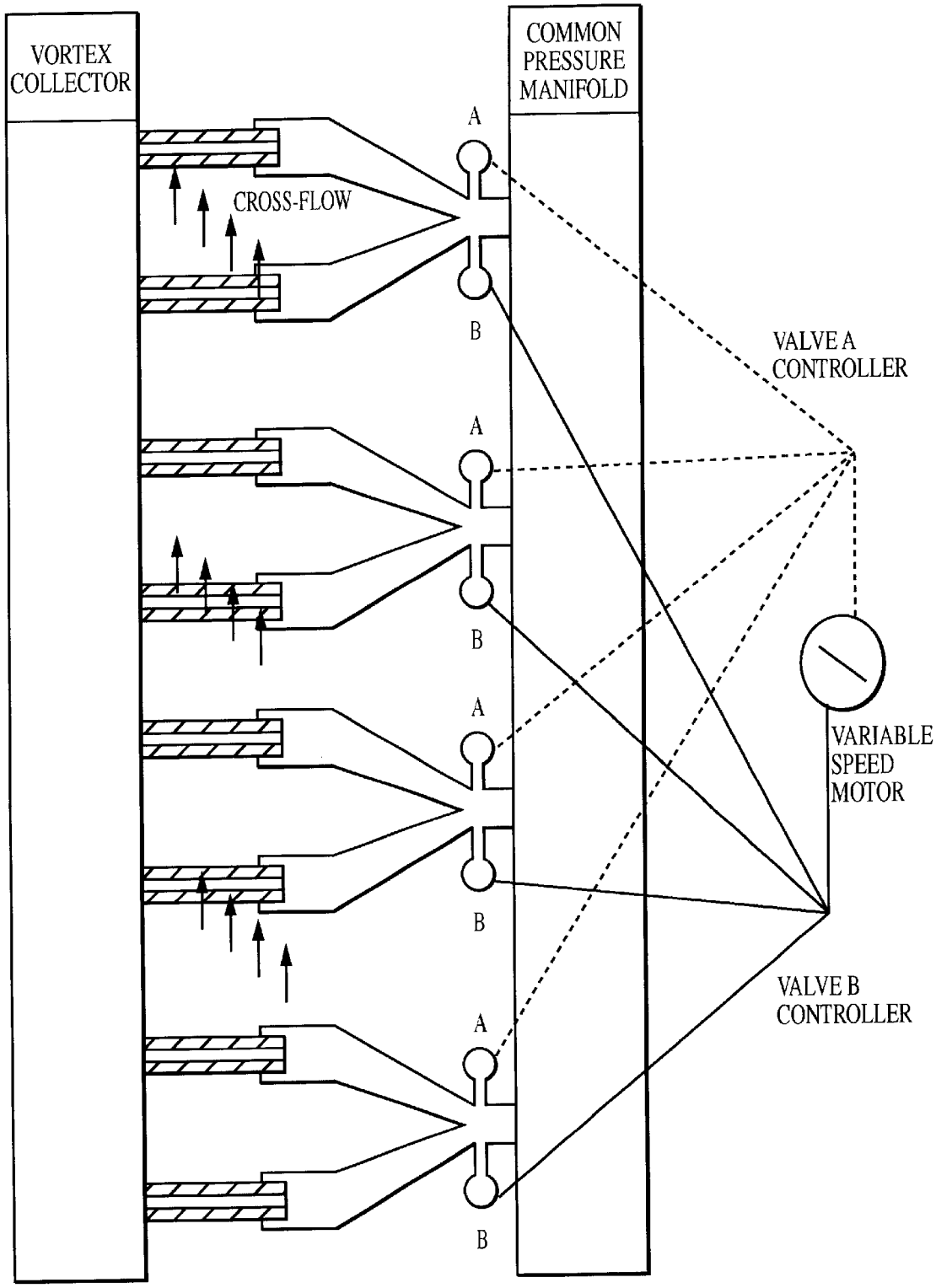
FIG. 14 shows an embodiment with multiple platens and nozzles.

As shown in FIG. 14, the fluidic flip-flop pressure generator may be fitted with a large number of platens, a controller for simultaneous operation of valve A solenoids imposing downward impulses on the jet stream, a controller for valve B solenoids imposing upward impulses, and a variable speed motor to control lateral pulse timing.

A schematic of this embodiment is shown in FIG. 14 without shrouds. This illustration represents a standard commercial cross flow heat exchanger, but enhanced by a ring-vortex generator designed to lower maintenance and operational costs by continuously abrading the platens free of dirt, chemical deposits, rust, and other debris during the system life-cycle, and thereby improving heat transfer by improving surface conductance, convection, and radiation from the platen.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A method of using a vortex ring for pumping a fluid through a flexible, tubular platen comprising the steps of:

generating a vortex ring;

launching a vortex ring along the tubular platen so that the vortex ring encircles the tubular platen as the vortex ring moves along the tubular platen, wherein the vortex ring compresses and expands the flexible platen utilizing a high circumferential pressure formed at the bow of the vortex ring and a low pressure at the wake of the vortex ring; and using the compression and expansion of the tubular platen to pump fluid within the tubular platen.

2. A method of using a vortex ring for removing deposits from the surface of a platen, comprising the steps of:

generating a vortex ring;

launching a vortex ring along the surface of the platen for removing the deposits from the surface of the platen by mechanically abrading the platen surface with the vortex ring and fracturing the adhesion bonds of the surface deposits on the platen to lift the deposits from the surface of the platen; and entraining the surface deposits in the core of the vortex ring and transporting the deposits to a collector for recovery or disposal.

3. A method of using a vortex ring for transferring heat from a heated platen to a vortex ring, comprising the steps of:

generating a vortex ring;

launching a vortex ring along the surface of the heated platen for removing heat from the surface of the heated platen by means of forced convection where the heat is transferred to the vortex ring; and transporting the vortex ring to a collector and transferring heat in the vortex ring to the collector.

* * * * *